US005861080A

United States Patent [19]

Yang et al.

[11] Patent Number: 5,861,080

[45] Date of Patent: Jan. 19, 1999

[54] TAPE DISPENSER

[76] Inventors: Xinnong Yang, 1329 Milburn Ave., Redlands, Calif. 92373; Xinjun Yang, 601 - - G Eagle Heights, Madision, Wis. 53705

[21] Appl. No.: 828,726

[22] Filed: Mar. 25, 1997

[51] Int. Cl.[6] ..... B32B 31/00

[52] U.S. Cl. ..... 156/576; 156/577; 225/39; 225/56; 225/63

[58] Field of Search ..... 156/574, 576, 156/577, 579; 225/39, 46, 54, 56, 63

[56] References Cited

U.S. PATENT DOCUMENTS

| | | | |
|---|---|---|---|
| 1,204,761 | 11/1916 | Hall | 156/576 X |
| 2,722,329 | 11/1955 | Vogt | 156/576 X |
| 3,156,603 | 11/1964 | Robinson . | |
| 3,523,053 | 8/1970 | Zbinden et al. | 156/576 X |
| 3,707,426 | 12/1972 | Robison . | |
| 3,709,761 | 1/1973 | Trueb et al. | 156/576 |
| 3,829,346 | 8/1974 | Sullivan | 156/577 X |
| 3,895,059 | 7/1975 | Link . | |
| 4,400,231 | 8/1983 | Martin . | |
| 4,591,407 | 5/1986 | Samuelson . | |
| 4,623,421 | 11/1986 | Cardin . | |
| 4,762,586 | 8/1988 | Wilkie | 156/576 X |
| 4,780,172 | 10/1988 | Shea . | |
| 5,181,983 | 1/1993 | Sakai | 156/577 X |
| 5,281,298 | 1/1994 | Poisson et al. . | |
| 5,288,362 | 2/1994 | Shuh-Chin . | |
| 5,380,395 | 1/1995 | Uchida | 156/577 |
| 5,381,942 | 1/1995 | Lin | 156/577 X |
| 5,384,003 | 1/1995 | Mitchell . | |
| 5,468,332 | 11/1995 | Dretzka et al. . | |
| 5,595,626 | 1/1997 | Yokouchi et al. | 156/577 |
| 5,670,014 | 9/1997 | Mendelovich et al. | 156/577 X |

*Primary Examiner*—Mark A. Osele
*Attorney, Agent, or Firm*—Armstrong, Westerman, Hattori, McLeland & Naughton

[57] ABSTRACT

An improved tape dispenser and method of use is capable of applying tape to a substrate with only one hand of the user, and comprises a housing having a pair of parallel spaced-apart resilient side walls which can be spread apart to receive a spool of tape rotatably mounted toward the rear of the dispenser; an upper support block mounted between the side walls toward the front end of the dispenser, a cutter blade mounted on the upper support block at the front end of the dispenser, a pressure-applying element in the form of an anvil bar or cushion extending between the side walls behind and below the cutter blade, a lower support bar extending between the side walls behind and below the anvil bar, and biasing means to bias the tape against the lower support bar, whereby, when tape is threaded between the pressure-applying element and the lower support bar, and the dispenser is pressed against a substrate to be taped, the tape is pressed by the biasing means and by a lower edge of the pressure-applying element against the substrate to apply the tape thereto.

17 Claims, 5 Drawing Sheets

TAPE DISPENSER

BACKGROUND OF THE INVENTION

1. Field of the Invention

This invention relates to tape dispensers, and especially to an improved dispenser from which tape is dispensed with one hand only, it not being necessary to draw an end of the tape from the dispenser with the other hand.

2. Description of the Prior Art

Many tape dispensers are known comprising a holder with means to carry the tape from a spool to an applicator and then to a serrated cutter. Such dispensers usually require a free end of the tape to be first pulled from the holder for application to a substrate to be taped. Examples of such dispensers are disclosed in U.S. Pat. Nos. 3,156,603; 3,707,426; 3,709,761; 3,895,059; 4,400,231; 4,591,407; 4,623,421; 4,780,172; 5,288,362; 5,384,003, and 5,468,332. Tape dispensers and applicators also are known having biasing means to apply pressure on a tape being dispensed. For example, U.S. Pat. No. 5,281,298 discloses a device for applying correction tape from a tape substrate onto a surface such as paper. The device comprises a supply reel 30 and a take-up reel 28. Tape passes from the supply reel to an applicator member 18 provided with an applicator bar 20 and which structure is biased downwardly and pressure on the bar results in application of the correction tape to the paper surface, the tape substrate then passing to the take-up reel. For biasing of the applicator bar 20, the device may include a spring (not shown) exerting downward pressure of 600 grams on the applicator bar, or the applicator member 18 may be constructed of a spring material. In either case, the device requires the provision of a separate applicator member having, as a part thereof, an applicator bar in contact with the tape to be dispensed.

SUMMARY OF THE INVENTION

According to the present invention, a housing, having a pair of parallel and spaced apart walls, provides means for rotatably mounting between the walls, toward a rear of the housing, a spool of tape having one side thereof coated with a pressure-sensitive adhesive. At a front end of the housing, there is provided an upper support block, extending between the walls of the housing, a cutter blade, mounted on the upper support block, and having a serrated cutting edge extending between the walls of the housing and projecting at least to a forward-most portion of the front end of the housing; a pressure-applying element, extending between the walls of the housing and spaced behind and, in an operating position of the dispenser, below the cutter blade, and a lower support bar, extending between the walls of the housing and spaced behind and, in the dispenser operating position, below the pressure-applying element. Biasing means are provided to bias the tape, extending between the lower support bar and the biasing means, with the adhesive side of the tape against the lower support bar such that the tape, when unwound from the tape spool, is held between the biasing means and the lower support bar by the biasing force exerted by biasing means. In an operating position of the dispenser, the front end of the dispenser is pressed against a substrate to be taped, whereby the tape is forced against a lower surface of the pressure-applying element which then presses the tape against the substrate. The tape is applied to the substrate merely by pulling the dispenser along the surface of the substrate.

DESCRIPTION OF PREFERRED EMBODIMENTS

Figure 1:
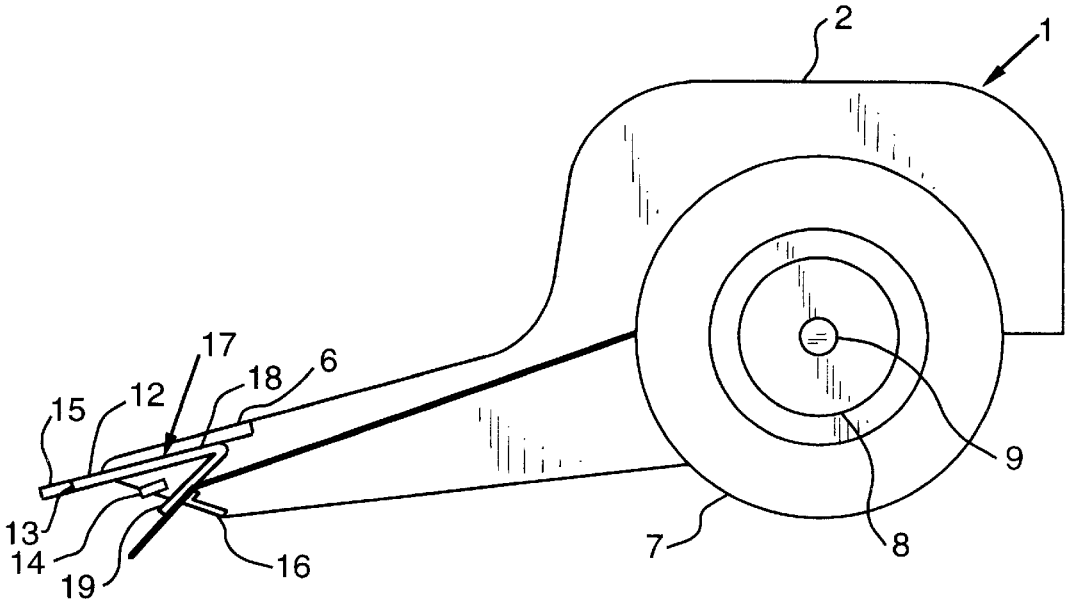
FIG. 1 is a side elevational view of one form of the tape dispenser of the invention, with one side wall of the housing removed to show the details of the dispensing mechanism.
Figure 2:
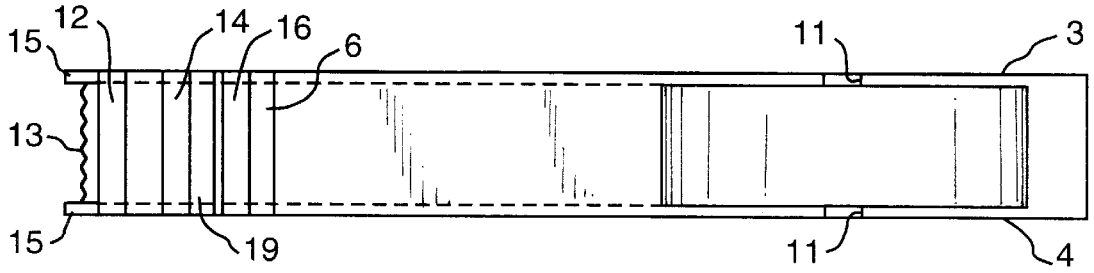
FIG. 2 is a top plan view of the tape dispenser shown in FIG. 1.

In FIGS. 1 and 2 there are shown a dispenser, denoted generally by the numeral 1, comprising a housing 2, with parallel, spaced-apart side walls 3 and 4, joined together at a front end thereof by means of an upper support block 6. Walls 3 and 4 may be made of a semi-rigid material, such as a suitable plastic, so that rearward portions of the walls may be spread apart to receive a spool of tape 7 mounted on a core 8 and rotatable on an axle 9 extending through holes 11 in walls 3 and 4. Alternatively, walls 3 and 4 may be rigid and have slots (not shown) for reception of axle 9 of tape spool 7. Front ends of the walls 3 and 4 are bevelled so as to form an application face A (FIGS. 3 and 4A–4C).

A cutter blade 12 is mounted on the upper support block 6 and has a serrated, forwardly facing cutting edge 13 for cutting the tape 7. Ears 15 preferably extend forwardly of the cutting edge 13 to protect a surface to be taped against scratching by the cutter blade while the tape is being cut.

Extending between walls 3 and 4 is a pressure-applying element 14 spaced behind and below the cutter blade 12 with a lower edge thereof lying substantially in the plane of the face A of the dispenser. Element 14 may be in the form of an anvil bar or cushion made of any suitable material, such as plastic or metal, or, in case of a cushion, plastic or rubber. In any case, element 14 provides a linear edge against which the tape may be pressed against a surface to be taped. A lower support bar 16 is spaced behind and below the pressure-applying element 14 with a lower surface thereof lying substantially in the plane of face A. A V-shaped spring-like elastic plate, denoted generally by the numeral 17, comprises a first leg 18 mounted on the upper support block 6 and a second, free leg 19 which, due to the spring-like nature of the material of plate 17, is biased downwardly to rest, in a normal position of the dispenser, against an upper edge of the lower support bar 16.

Figure 3:
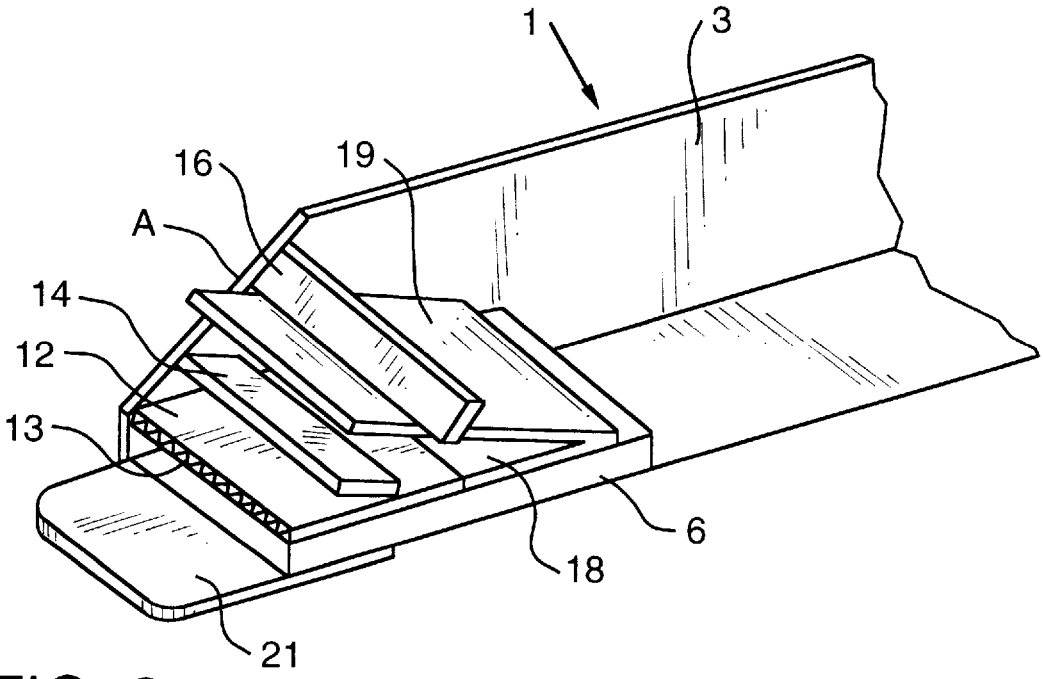
FIG. 3 is an isometric view of the dispensing end of one form of the dispenser of the invention.

The aforesaid elements of the dispenser of the invention are perhaps more clearly shown in the isometric view of the front end of the dispenser of FIG. 3. As clearly shown in FIG. 3, the dispenser 1 has a forward portion of the walls 3 and 4 bevelled or sloped at an angle to the remainder of the walls and forming the dispenser application face A. As also shown in FIG. 3, the dispenser may further comprise an apron 21, mounted on the upper support block 6 and extending forwardly of the front end or face A of the dispenser, to catch and hold a free end of the tape 7 after dispensing, application and cutting of the tape.

Figure 4A:
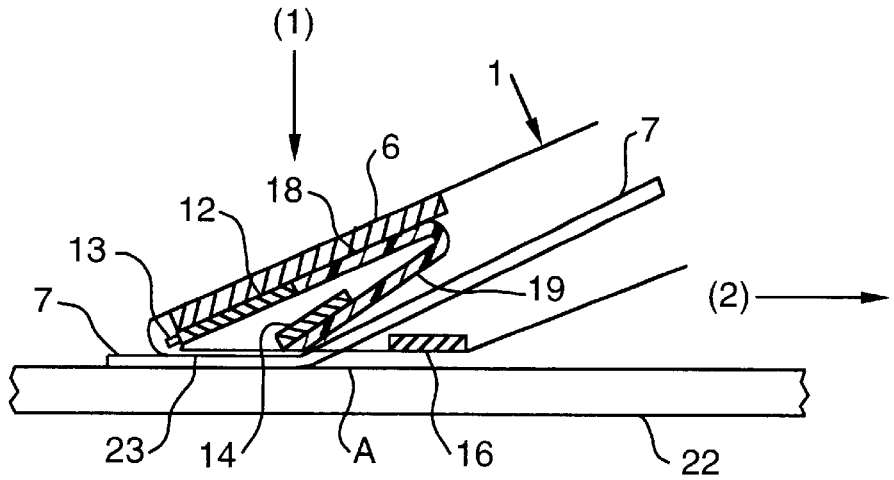
FIG. 4A is a cross-sectional side elevation of the front end of a dispenser according to the invention, showing the dispenser in an operative position dispensing tape onto a substrate.
Figure 4B:
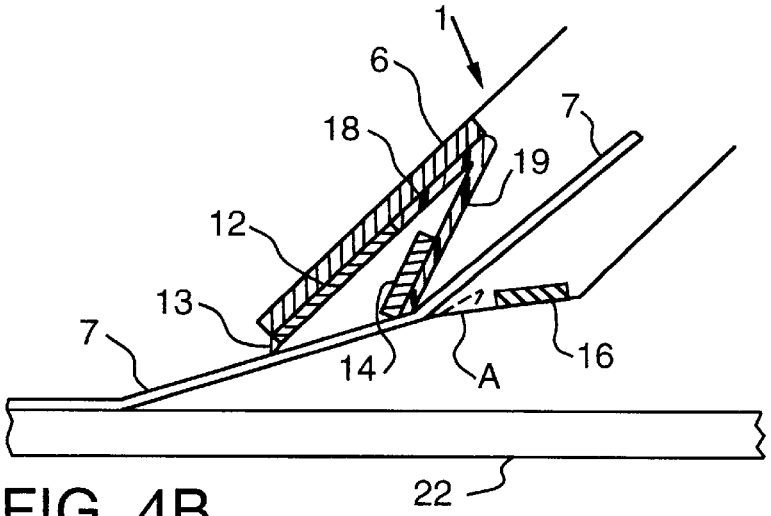
FIG. 4B is a similar view of the dispenser of FIG. 4A, showing the dispenser lifted above the substrate in a position for cutting the tape after dispensing.
Figure 4C:
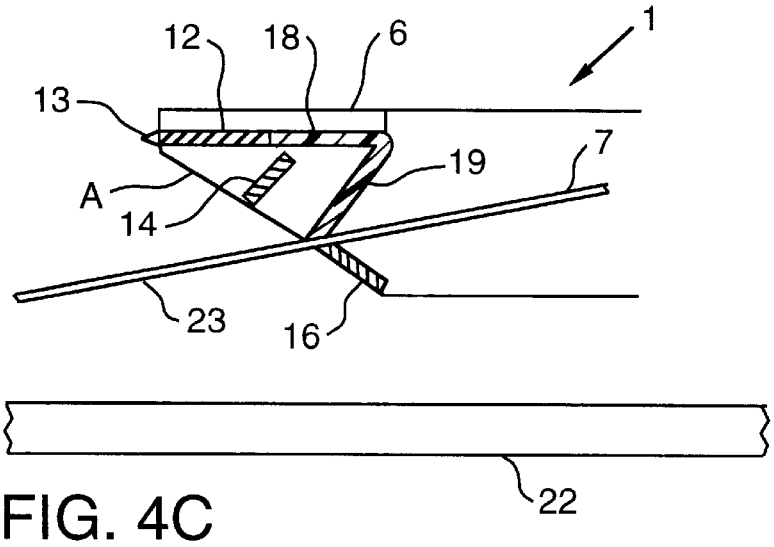
FIG. 4C is a similar view, showing the dispenser in its normal, non-operative position.

Operation of the dispenser and applicator of the invention is illustrated in FIGS. 4A–4C. In FIG. 4A, the face A of the front end of the dispenser is positioned with the face A facing downwardly onto a substrate 22 to which tape is to be applied, with pressure-applying element 14 and lower support bar 16 resting against the substrate surface. As there shown, tape 7 is threaded from the spool of tape, between the free leg 19 of the elastic plate 17 and lower support bar 16, with an adhesive-carrying side of the tape facing downwardly toward the lower support bar 16 and with the tape biased and held by leg 19 against an upper edge of the lower support bar. A free end 23 of tape 7 extends beyond the edge of the lower support bar, ready for application to substrate 22. As shown by the arrow (1), the dispenser is pushed, by one hand of the user, downwardly against the substrate 22, thus forcing free leg 19 of elastic plate 17 upwardly, against the pressure applying element 14, i.e. an anvil bar or cushion, and the free end 23 of tape 7 down against the substrate, ready for application thereto by the resulting pressure of the anvil bar or cushion 14 against the upper, non-adhesive side of the tape and against the substrate. Next, with the same one hand, the user pulls the dispenser to the right in FIG. 4A, as shown by arrow (2), with the result that the tape automatically is pulled from the dispenser and applied to the substrate 22.

As shown in FIG. 4B, when application of the tape to the substrate is completed, the dispenser is raised off the substrate and given a slight twist, resulting in the tape being cut by serrated edge 13 of cutter blade 12, with a free end portion 23 of tape 7 extending beyond the lower support bar 16 and anvil bar or cushion 14, ready for the next use of the dispenser.

When the dispenser is not in use, the normal, rest position of the elastic plate 17, specifically free leg 19 thereof, is shown in FIG. 4C. As there illustrated, in such position, the free leg 19 of plate 17 is biased against the tape 7 which is held between leg 19 and an upper edge of the lower support bar 16, and, as described and shown in FIG. 4B, a free end 23 of tape 7 is left extending beyond the lower support bar 16 and anvil bar or cushion 14, ready for the next use of the dispenser.

Figure 5:
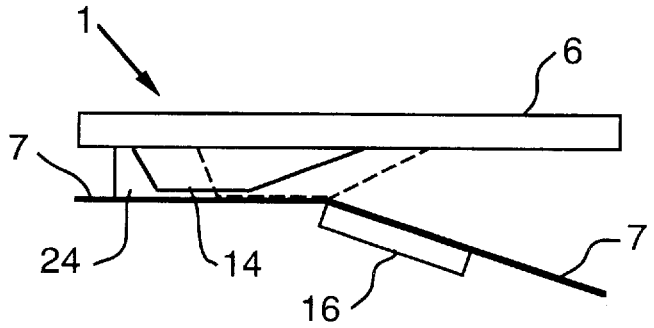
FIG. 5 is a sketch, in side elevation, of a modification of the dispenser of the invention showing a horizontally movable anvil block serving as the tape biasing means.

In the embodiment of the invention illustrated in FIG. 5, the anvil bar or cushion 14 is horizontally movable into and out of engagement with the lower support bar 16, being biased to such engagement, for example, by means of a spring 24. Operation of the device otherwise is similar to that of the embodiment of FIGS. 1–4.

Figure 6:
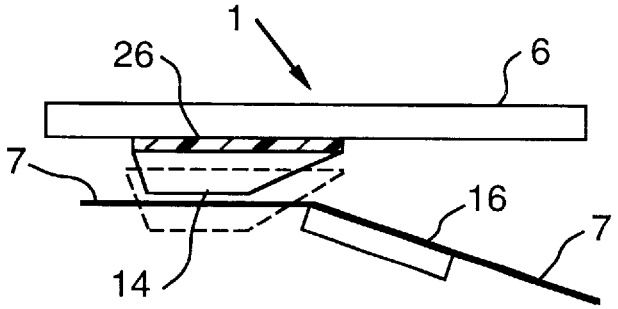
FIG. 6 is a sketch, in side elevation, of a further modification of the dispenser of the invention showing a vertically movable anvil block serving as the tape biasing means.

In FIG. 6, the anvil bar or cushion 14 is vertically movable, being biased in a downward direction, for example by a spring (not shown) or by a resilient material 26, for pressing tape 7 into contact with the lower support bar 16.

Figure 7:
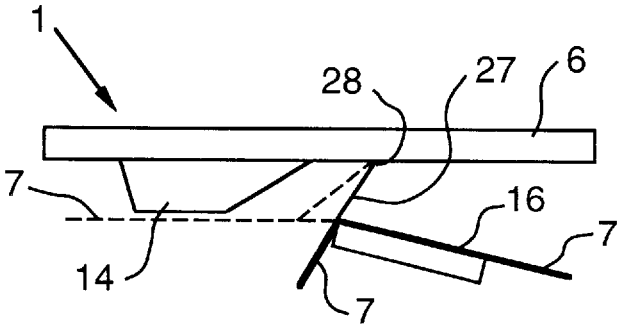
FIG. 7 is sketch, in side elevation, of a yet further modification of the invention showing a single leg elastic plate as the tape biasing means.

FIG. 7 shows a still further embodiment of the invention in which an elastic plate 27 is connected at one end, as at 28, to the upper support block 6 and biased, by the spring-like nature of the material of which plate 27 is formed, against the lower support block 16, with tape 7 pressed between these two elements.

Figure 8:
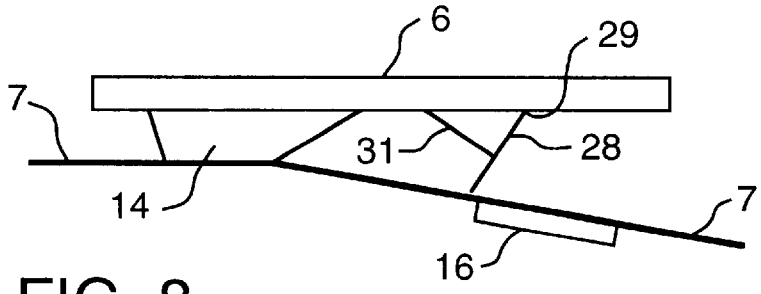
FIG. 8 is a sketch, in side elevation, of a still further modification of the invention, showing a rigid plate with a spring-biasing means.

In FIG. 8, another embodiment is shown in which a rigid plate 28 is pivotally connected, as at 29, to the upper support block 6 and is biased against the lower support block 16 by suitable elastic means such as a spring 31.

Figure 9:
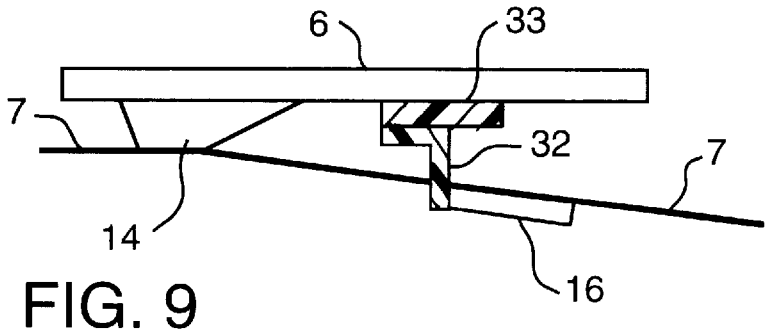
FIG. 9 is a sketch, in side elevation, of yet another modification of the invention, showing a vertically biased rigid biasing plate.

In FIG. 9, a rigid biasing plate 32 is vertically biased against the lower support bar 16, as by a resilient material layer 33.

Figure 10:
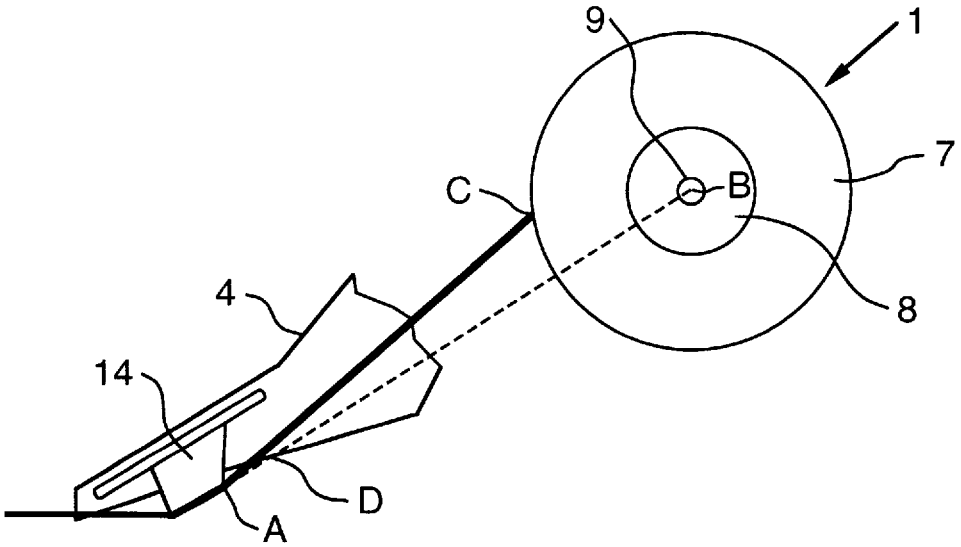
FIG. 10 is a side elevational view of a dispenser of the invention showing important geometric relationships of elements of the dispenser.

Important geometric relationships of elements of the dispenser of the invention are illustrated in FIG. 10 wherein tape 7 is unwound from spool core 8 and leaves the spool of tape at point C. The tape 7 is applied to a substrate at point A on the pressure-applying anvil bar or cushion 14. Leaving point C and applying point A comprise a straight line AC. Line AC always is above the line AB linking point A and the axis of the roll of tape, point B. In order to leave enough space for the tape 7 to be released from the locking position at the lower support bar 16, the best location of the lower support bar 16 usually is at or below the intersection of line AB and the bottom edges of the side walls 3 and 4, i.e. point D in FIG. 10.

Contrary to conventional tape dispensers which require that an end of the tape be extracted from the dispenser with one hand, and the other hand used to apply the dispensed tape to a substrate, the dispenser of the invention requires only one hand—to apply the tape to a substrate, as shown and described. The biasing element retains the tape 7, and the free end 23 thereof, in position ready for use simply when the dispenser is pushed downwardly against the substrate and pulled along the substrate surface. In use, the biasing element is forced upwardly and, due to the spring-like elasticity of the biasing element, it presses against the smooth, adhesive-free side of tape 7, so that the tape is ready for application simply by pulling the dispenser along the surface of the substrate to be taped.

The dispensing system of the invention locks the tape movement immediately after the tape is cut, keeps the free end of the tape in a straight, forward direction, and prevents the free end of the tape from rolling back to the housing or from curling and sticking to itself. The system is designed to only let the tape pass through the dispenser unidirectionally, which lets the tape easily be pulled out of the dispenser, but prevents it from going in the other direction. The system also leaves enough length of tape in a rest position for the next application. The tape biasing means provides a smooth and clean surface of the free end of the tape, making the tape easy to apply.

What is claimed is:

1. A tape dispenser comprising a pair of elongated side walls, means to mount a spool of pressure-sensitive tape between the side walls toward a rear end thereof, an upper support block fixedly mounted between and connected to the side walls toward a front end of the dispenser, a cutter blade fixedly mounted on the upper support block at a forward end thereof, a non-movable anvil bar fixedly mounted between and connected to the side walls behind and below the cutter blade, a non-movable lower support bar fixedly mounted on and extending between the side walls behind and below the anvil bar, and a tape biasing means disposed between the anvil bar and the lower support bar and serving, in a rest position of the dispenser, to bias the tape against the lower support bar, with an adhesive-coated side of the tape thereagainst and wherein, in a dispensing position, an uncoated side of the tape is pressed against the anvil bar and an adhesive-coated side of the tape is pressed by a lower edge of the anvil bar against a substrate to be taped.

2. An improved tape dispenser capable of dispensing and applying one-side adhesive-coated pressure-sensitive tape to a substrate with the use of only one hand of a user, comprising an elongated housing having a pair of parallel spaced-apart side walls which are bevelled at front ends of the walls forming an application face of the dispenser, means to rotatably mount a spool of tape between the side walls toward a rear end of the dispenser, an upper support block mounted between and connected to the side walls at an upper front end thereof, a cutter blade for cutting the tape mounted on the upper support block and having a front end of the cutter blade adjacent a front end of the dispenser and lying substantially in the plane of the application face of the dispenser, an anvil bar fixedly connected at each end thereof to a corresponding side wall and positioned behind and below the front end of the cutter blade and having a lower edge thereof lying substantially in the plane of the application face, a lower support bar connected at each end to a corresponding side wall and positioned below and behind the anvil bar and having a lower edge thereof lying substantially in the plane of the application face, and tape biasing means disposed between the anvil bar and the lower support bar and adapted, in a rest position of the dispenser, to press an adhesive-coated surface of the tape against an upper edge of the lower support bar and, in a tape-applying use position, together with the anvil bar, to press the adhesive-coated surface of the tape against a substrate to be taped.

3. A tape dispenser comprising a pair of elongated side walls, means to mount a spool of pressure-sensitive tape between the side walls toward a rear end thereof, an upper support block mounted between and connected to the side walls toward a front end of the dispenser, a cutter blade mounted on the upper support block at a forward end thereof, an anvil bar mounted between the side walls behind and below the cutter blade, a lower support bar mounted between the side walls behind and below the anvil bar, and a tape biasing means comprising a V-shaped elastic plate having a first leg juxtaposed to the upper support block and a free leg extending between the anvil bar and the lower support bar and, in a rest position of the dispenser, biased against the lower support bar with an adhesive-coated side of the tape thereagainst and wherein, in a dispensing position, said free leg lies against the anvil bar with an uncoated side of the tape pressed against the anvil bar and an adhesive-coated side of the tape pressed by the anvil bar against a substrate to be taped.

4. An improved tape dispenser capable of dispensing and applying one-side adhesive-coated pressure-sensitive tape to a substrate with the use of only one hand of a user, comprising an elongated housing having a pair of parallel spaced-apart side walls which are bevelled at front ends of the walls forming an application face of the dispenser, means to rotatably mount a spool of tape between the side walls toward a rear end of the dispenser, an upper support block mounted between the side walls at an upper front end thereof, a cutter blade for cutting the tape mounted on the upper support block and having a front end of the cutter blade adjacent a front end of the dispenser and lying substantially in the plane of the application face of the dispenser, an anvil bar connected at each end thereof to a corresponding side wall and positioned behind and below the front end of the cutter blade and having a lower edge thereof lying substantially in the plane of the application face, a lower support bar connected at each end to a corresponding side wall and positioned below and behind the anvil bar and having a lower edge thereof lying substantially in the plane of the application face, and tape biasing means comprising a V-shaped elastic plate having one leg thereof mounted on the upper suipport block and a free leg thereof extending between the anvil bar and the lower support bar and adapted, in a rest position of the dispenser, to press an adhesive-coated surface of the tape against an upper edge of the lower support bar and, in a tape-applying use position, together with the anvil bar, to press the adhesive-coated surface of the tape against a substrate to be taped.

5. A tape dispenser comprising a pair of elongated side walls, means to mount a spool of pressure-sensitive tape between the side walls toward a rear end thereof, an upper support block fixedly mounted between the side walls toward a front end of the dispenser, a cutter blade mounted on the upper support block at a forward end thereof, an anvil bar mounted on the upper support block and behind and below the cutter blade and horizontally movable with respect to the upper support block, a lower support bar mounted between the side walls behind and below the anvil bar, and wherein the anvil is adapted, in a rest position of the dispenser, to press an adhesive-coated surface of the tape against the lower support bar and, in a tape-dispensing position, to press the adhesive-coated surface of the tape against a substrate surface to be taped, and means to move the anvil bar into and out of rest and tape-dispensing positions.

6. An improved tape dispenser capable of dispensing and applying one-side adhesive-coated pressure-sensitive tape to a substrate with the use of only one hand of a user, comprising an elongated housing having a pair of parallel spaced-apart side walls which are bevelled at front ends of the walls forming an application face of the dispenser, means to rotatably mount a spool of tape between the side walls toward a rear end of the dispenser, an upper support block mounted between the side walls at an upper front end thereof, a cutter he upper supporting the tape mounted on the upper support block and having a front end of the cutter blade adjacent a front end of the dispenser and lying substantially in the plane of the application face of the dispenser, an anvil bar mounted on the upper support block and horizontally movable with respect thereto and positioned behind and below the front end of the cutter blade and having a lower edge thereof lying substantially in the plane of the application face, a lower support bar connected at each end to a corresponding side wall and positioned below and behind the anvil bar and having an edge thereof lying substantially in the plane of the application face, and the anvil bar being adapted, in a rest position of the dispenser, to press an adhesive-coated surface of the tape against an edge of the lower support bar and, in a tape-dispensing use position, to press the adhesive-coated surface of the tape against a substrate to be taped, and means to move the anvil bar into and out of rest and tape-dispensing positions.

7. A tape dispenser comprising a pair of elongated side walls, means to mount a spool of pressure-sensitive tape between the side walls toward a rear end thereof, an upper support block fixedly mounted between the side walls toward a front end of the dispenser, a cutter blade mounted on the upper support block at a forward end thereof, a tape biasing means comprising an anvil bar mounted on the upper support block and behind and below the cutter blade and vertically movable with respect to the upper support block, a lower support bar mounted between the side walls behind and below the anvil bar, and wherein the anvil bar is adapted, in a rest position of the dispenser, to press an adhesive-coated surface of the tape against the lower support bar and, in a dispensing position, to press the adhesive-coated surface of the tape against a substrate surface to be taped, and means to bias the anvil bar into and out of rest and tape-dispensing positions.

8. An improved tape dispenser capable of dispensing and applying one-side adhesive-coated pressure-sensitive tape to a substrate with the use of only one hand of a user, comprising an elongated housing having a pair of parallel spaced-apart side walls which are bevelled at front ends of the walls forming an application face of the dispenser, means to rotatably mount a spool of tape between the side walls toward a rear end of the dispenser, an upper support block mounted between the side walls at an upper front end thereof, a cutter blade for cutting the tape mounted on the upper support block and having a front end of the cutter blade adjacent a front end of the dispenser and lying substantially in the plane of the application face of the dispenser, tape biasing means comprising an anvil bar mounted on the upper support block and vertically movable with respect thereto, wherein, in a rest position of the dispenser, the anvil bar biases the tape against the lower support bar, with an adhesive-coated side of the tape there-against and, in a dispensing position, an adhesive-coated side of the tape is pressed by the anvil bar against a substrate to be taped, and means to bias the anvil.

9. A tape dispenser comprising a pair of elongated side walls, means to mount a spool of pressure-sensitive tape between the side walls toward a rear end thereof, an upper support block mounted between the side walls toward a front end of the dispenser, a cutter blade mounted on the upper support block at a forward end thereof, an anvil bar mounted between the side walls behind and below the cutter blade, a lower support bar mounted between the side walls behind and below the anvil bar, and a tape biasing means comprising an elongated elastic plate affixed at one end to the upper support block and having another end biased, in a rest position of the dispenser, against the lower support bar and serving, in a rest position of the dispenser, to bias the tape against the lower support bar, with the tape disposed, adhesive-coated surface down, between the elastic plate and the lower support bar.

10. An improved tape dispenser capable of dispensing and applying one-side adhesive-coated pressure-sensitive tape to a substrate with the use of only one hand of a user, comprising an elongated housing having a pair of parallel spaced-apart side walls which are bevelled at front ends of the walls forming an application face of the dispenser, means to rotatably mount a spool of tape between the side walls toward a rear end of the dispenser, an upper support block mounted between the side walls at an upper front end thereof, a cutter blade for cutting the tape mounted on the upper support block and having a front end of the cutter blade adjacent a front end of the dispenser and lying substantially in the plane of the application face of the dispenser, an anvil bar mounted between the side walls behind and below the cutter blade, and a tape biasing means comprising an elongated elastic plate affixed at one end to the upper support block and a lower end disposed between the anvil bar and the lower support bar and adapted, in a rest position of the dispenser, to bias the tape against the lower support bar with the tape disposed, in a rest position of the dispenser, against the lower support bar, with the tape disposed, adhesive-coated surface down, between the elastic plate and the lower support bar.

11. A tape dispenser comprising a pair of elongated side walls, means to mount a spool of pressure-sensitive tape between the side walls toward a rear end thereof, an upper support block mounted between the side walls toward a front end of the dispenser, a cutter blade mounted on the upper support block at a forward end thereof, an anvil bar mounted between the side walls behind and below the cutter blade, a lower support bar mounted between the side walls behind and below the anvil bar, and a tape biasing means comprising a rigid plate having one end thereof pivotally connected to the upper support block and having another end thereof biased, in a rest position of the dispenser, against the lower support block, with the tape disposed, adhesive-coated surface down, between the rigid plate and the lower support bar, and means to bias the rigid plate in such position.

12. An improved tape dispenser capable of dispensing and applying one-side adhesive-coated pressure-sensitive tape to a substrate with the use of only one hand of a user, comprising an elongated housing having a pair of parallel spaced-apart side walls which are bevelled at front ends of the walls forming an application face of the dispenser, means to rotatably mount a spool of tape between the side walls toward a rear end of the dispenser, an upper support block mounted between the side walls at an upper front end thereof, a cutter blade for cutting the tape mounted on the upper support block and having a front end of the cutter blade adjacent a front end of the dispenser and lying substantially in the plane of the application face of the dispenser, an anvil bar mounted between the side walls behind and below the cutter blade, and a tape biasing means comprising a rigid plate having one end thereof pivotally connected to the upper support block and having another end thereof biased, in a rest position of the dispenser, against the lower support block, with the tape disposed, adhesive-coated surface down, between the rigid plate and the lower support bar, and means to bias the rigid plate in such position.

13. A tape dispenser comprising a pair of elongated side walls, means to mount a spool of pressure-sensitive tape between the side walls toward a rear end thereof, an upper support block mounted between the side walls toward a front end of the dispenser, a cutter blade mounted on the upper support block at a forward end thereof, an anvil bar mounted between the side walls behind and below the cutter blade, a lower support bar mounted between the side walls behind and below the anvil bar, and a tape biasing means comprising a rigid plate connected to the upper support block and vertically biased, in a rest position of the dispenser, against the lower support block, with the tape disposed, adhesive-coated surface down, between the rigid plate and the lower support bar, and means to bias the rigid plate in such position.

14. An improved tape dispenser capable of dispensing and applying one-side adhesive-coated pressure-sensitive tape to a substrate with the use of only one hand of a user, comprising an elongated housing having a pair of parallel spaced-apart side walls which are bevelled at front ends of the walls forming an application face of the dispenser, means to rotatably mount a spool of tape between the side walls toward a rear end of the dispenser, an upper support block mounted between the side walls at an upper front end thereof, a cutter blade for cutting the tape mounted on the upper support block and having a front end of the cutter blade adjacent a front end of the dispenser and lying substantially in the plane of the application face of the dispenser, an anvil bar fixedly mounted between the side walls behind and below the cutter blade, and a tape biasing means comprising a rigid plate connected to the upper support block and vertically biased, in a rest position of the dispenser, against the lower support block, with the tape disposed, adhesive-coated surface down, between the rigid plate and the lower support bar, and means to bias the rigid plate in such position.

15. A tape dispenser comprising a pair of elongated side walls, means to mount a spool of pressure-sensitive tape between the side walls toward a rear end thereof, an upper support block mounted between the side walls toward a front end of the dispenser, a cutter blade mounted on the upper support block at a forward end thereof, an anvil bar mounted between the side walls behind and below the cutter blade, a lower support bar mounted between the side walls behind and below the anvil bar, and a tape biasing means serving, in a rest position of the dispenser, to bias the tape against the lower support bar, with an adhesive-coated side of the tape thereagainst and wherein, in a dispensing position, an uncoated side of the tape is pressed against the anvil bar and an adhesive-coated side of the tape is pressed by the anvil bar against a substrate to be taped, and wherein a dimension between a point A of application of tape to a substrate by the anvil bar and a center B of the spool of tape is a straight line AB, a dimension between point A and a point C where the tape leaves the spool is a line AC, line AC lies above line AB, and the lower support bar is located substantially at or below the intersection of line AB and the bottom edges of the side walls of the dispenser.

16. An improved tape dispenser capable of dispensing and applying one-side adhesive-coated pressure-sensitive tape to a substrate with the use of only one hand of a user, comprising an elongated housing having a pair of parallel spaced-apart side walls which are bevelled at front ends of the walls forming an application face of the dispenser, means to rotatably mount a spool of tape between the side walls toward a rear end of the dispenser, an upper support block mounted between the side walls at an upper front end thereof, a cutter blade for cutting the tape mounted on the upper support block and having a front end of the cutter blade adjacent a front end of the dispenser and lying substantially in the plane of the application face of the dispenser, an anvil bar connected at each end thereof to a corresponding side wall and positioned behind and below the front end of the cutter blade and having a lower edge thereof lying substantially in the plane of the application face, a lower support bar connected at each end to a corresponding side wall and positioned below and behind the anvil bar and having an edge thereof lying substantially in the plane of the application face, and tape biasing means adapted, in a rest position of the dispenser, to press an adhesive-coated surface of the tape against an upper edge of the lower support bar and, in a tape-applying use position, together with the anvil bar, to press the adhesive-coated surface of the tape against a substrate to be taped, and wherein a dimension between a point A of application of tape to a substrate by the anvil bar and a center B of the spool of tape is a straight line AB, a dimension between point A and a point C where the tape leaves the spool is a line AC, line AC lies above line AB, and the lower support bar is located substantially at or below the intersection of line AB and the bottom edges of the side walls of the dispenser.

17. A tape dispenser according to one of claims 5, 7, 9, or 14 wherein a dimension between a point A of application of tape to a substrate by the anvil bar and a center B of the spool of tape is a straight line AB, a dimension between point A and a point C where the tape leaves the spool is a line AC, line AC lies above line AB, and the lower support bar is located substantially at or below the intersection of line AB and the bottom edges of the side walls of the dispenser.

* * * * *